US012337377B2

(12) United States Patent
Rumikewitz

(10) Patent No.: US 12,337,377 B2
(45) Date of Patent: Jun. 24, 2025

(54) METHOD FOR CASTING CASTINGS

(71) Applicant: Fritz Winter Eisengiesserei GmbH & Co. KG, Stadtallendorf (DE)

(72) Inventor: Jörg Rumikewitz, Amöneburg (DE)

(73) Assignee: Fritz Winter Eisengiesserei GmbH & Co. KG, Stadtallendorf (DE)

( * ) Notice: Subject to any disclaimer, the term of this patent is extended or adjusted under 35 U.S.C. 154(b) by 0 days.

(21) Appl. No.: 18/570,689

(22) PCT Filed: Jun. 15, 2022

(86) PCT No.: PCT/EP2022/066323

§ 371 (c)(1),
(2) Date: Dec. 15, 2023

(87) PCT Pub. No.: WO2022/263517

PCT Pub. Date: Dec. 22, 2022

(65) Prior Publication Data

US 2024/0278312 A1 Aug. 22, 2024

(30) Foreign Application Priority Data

Jun. 17, 2021 (DE) ..... 10 2021 115 727.7

(51) Int. Cl.
*B22C 9/04* (2006.01)
*B22C 9/10* (2006.01)

(52) U.S. Cl.
CPC ..... *B22C 9/046* (2013.01); *B22C 9/10* (2013.01)

(58) Field of Classification Search
CPC .. B22C 9/04; B22C 9/043; B22C 9/10; B22C 9/046
USPC ..... 164/34, 369
See application file for complete search history.

(56) References Cited

U.S. PATENT DOCUMENTS

| | | | | |
|---|---|---|---|---|
| 9,890,439 | B2 * | 2/2018 | Arnold et al. | B22C 9/02 |
| 2009/0145570 | A1 | 6/2009 | Montero | |
| 2012/0097357 | A1 | 4/2012 | Terashima | |
| 2017/0198366 | A1 | 7/2017 | Arnold et al. | |

FOREIGN PATENT DOCUMENTS

| | | | |
|---|---|---|---|
| WO | 2011013730 | A1 | 2/2011 |
| WO | 2016016035 | A1 | 2/2016 |

* cited by examiner

*Primary Examiner* — Kevin P Kerns
(74) *Attorney, Agent, or Firm* — The Webb Law Firm

(57) ABSTRACT

A process for casting castings in which a casting mold is provided, the casting mold is enclosed in a housing, forming a filling space between at least one inner surface section of the housing and an associated outer surface section of the casting mold, the filling space is filled with a pourable filling material having a bulk density that allows gas to flow through the filling material after the filling of the filling space, and a metal melt is poured into the casting mold. The casting mold radiates heat as a result of the heat input caused by the metal melt, and as a result of the heat input caused by the metal melt, the binder begins to evaporate and burn, no longer binding the molding material, and the casting mold disintegrates into fragments. The filling material has a temperature of less than 100° C. when filled into the filling space.

3 Claims, 2 Drawing Sheets

METHOD FOR CASTING CASTINGS

CROSS-REFERENCE TO RELATED APPLICATIONS

This application is the United States national phase of International Application No. PCT/EP2022/066323 filed Jun. 15, 2022, and claims priority to German Patent Application No. 10 2021 115 727.7 filed Jun. 17, 2021, the disclosures of which are hereby incorporated by reference in their entireties.

BACKGROUND OF THE INVENTION

Field of the Invention

The invention relates to a method for casting castings, in which a metal melt is poured into a casting mold which surrounds a cavity forming the casting to be produced, wherein the casting mold, formed as a lost mold, consists of one or more casting mold parts or -cores which are formed from a molding material consisting of a core sand, a binder and optionally one or more additives for adjusting certain properties of the molding material. In the course of this method, the respective casting mold provided is enclosed in a housing in such a way that a filling space is formed between at least one inner surface section of the housing and an associated outer surface section of the casting mold. The filling space is then filled with free-flowing filling material, wherein the filling material filled into the filling space has such a low bulk density that a gas flow can flow through the filling material package formed there from the filling material after the filling of the filling space. The metal melt is poured into the casting mold enclosed in this way, wherein the casting mold begins to radiate heat as the metal melt is poured in, as a result of the heat input caused by the hot metal melt, and wherein as a result of the heat input caused by the metal melt, the binder of the molding material begins to evaporate and burn, so that it loses its effect and the casting mold disintegrates into fragments.

Description of Related Art

The basic features of the method that takes place in this way and the embodiments of this method that are advantageous for practical implementation are described in WO 2016/016035 A1.

As explained there, in the field of iron casting, quartz sands mixed with bentonites, lustrous carbon formers and water are usually used as the molding material for the casting mold parts that form the outer finish of the casting mold. The casting cores that form the internal cavities and channels of the casting, on the other hand, are usually formed from commercially available core sands mixed with an organic or inorganic binder, e.g. a synthetic resin or water glass.

Irrespective of the type of core sands and binders, the basic principle in the production of casting molds formed from molding materials of the aforementioned type is that after shaping, the binder is hardened by a suitable thermal or chemical treatment so that the grains of the core sand stick together and the dimensional stability of the respective mold part or -core is ensured over a sufficient period of time.

The internal pressure on the casting mold after the metal melt has been poured can be very high, especially when casting large-volume castings from cast iron. In order to absorb this pressure and prevent the casting mold from bursting, either thick-walled, large-volume casting molds or support structures must be used supporting the casting mold on its outside.

One possibility for such a support structure is an enclosure that is placed over the casting mold. The enclosure is usually designed in the form of a jacket that surrounds the casting mold on its circumferential sides, but has a sufficiently large opening on its upper side to allow the melt to be poured into the casting mold. The enclosure is dimensioned in such a way that after the placement a filling space remains between the inner surfaces of the enclosure and the outer surfaces of the casting mold, at least in the sections that are crucial for supporting the casting mold. This filling space is filled with a free-flowing filling material so that a large-area support of the respective surface section on the enclosure is ensured. In order to achieve the most uniform possible filling of the filling space, an equally uniform contact of the casting mold with the filling material and a correspondingly uniform support of the fragile casting mold material, fine-grained, free-flowing filling materials, such as sand or steel shot, which have a high bulk density, are generally used as the filling material. After filling, the filling material is additionally compacted. The aim here is to produce a filling mass that is as compact as possible and ensures the direct transfer of the supporting forces from the enclosure to the casting mold in the manner of an incompressible monolith.

The metal melt is poured into the casting mold at a high temperature, so that the mold parts and -cores that make up the casting mold are also heated up considerably. As a result, the casting mold begins to radiate heat. If the temperature of the casting mold exceeds a certain minimum temperature, the binder of the molding material begins to evaporate and burn, releasing further heat. This causes the binder to lose its effect. Due to this decomposition of the binder, the bonding of the grains of the molding material from which the mold parts and -cores of the casting mold are made is lost and the casting mold or its parts and cores consisting of molding material disintegrate into individual fragments.

Based on this, WO 2016/016035 A1 proposes the use of a preheated filling material for filling the filling space between the casting mold and the enclosure, wherein the filling temperature of the filling material is so high that, starting from the filling temperature, the temperature of the filling material rises due to process heat, which is generated by the heat radiated by the casting mold and by the heat released during the burning of the binder, the temperature of the filling material rises to above a limit temperature at which the binder evaporating from the casting mold and coming into contact with the filling material ignites and starts to burn. In this way, the filling material is used as a heat accumulator, which is tempered and designed in such a way that the decomposition of the binder of the molding material, from which the casting mold parts and -cores of the casting mold are made, progresses as far as possible during the dwell time in the enclosure due to the effect of temperature. 500° C. was regarded as a suitable lower limit for the range of filling temperatures.

Based on this, the object has arisen of improving the known method in such a way that the rapid and energy-efficient decomposition of the casting mold is achieved with reduced effort.

The invention has solved this object by the method specified as described herein.

Advantageous embodiments of the invention are given in the dependent claims and are explained in detail below, as is the general idea of the invention.

SUMMARY OF THE INVENTION

Accordingly, the invention provides a method for casting castings in which, in accordance with the prior art described above, a metal melt is poured into a casting mold which surrounds a cavity forming the casting to be produced, wherein the casting mold, formed as a lost mold, consists of one or more casting mold parts or -cores which are formed from a molding material consisting of a core sand, a binder and optionally one or more additives for adjusting certain properties of the molding material, comprising the following working steps:

providing the casting mold;

enclosing the casting mold in a housing, forming a filling space between at least one inner surface section of the housing and an associated outer surface section of the casting mold;

filling the filling space with free-flowing filling material, wherein the filling material filled into the filling space has such a low bulk density that a gas flow can flow through the filling material package formed there from the filling material after the filling of the filling space;

and pouring the metal melt into the casting mold, wherein the casting mold begins to radiate heat as the metal melt is poured in, as a result of the heat input caused by the hot metal melt, and wherein as a result of the heat input caused by the metal melt, the binder of the molding material begins to evaporate and burn, so that it loses its effect and the casting mold disintegrates into fragments.

According to the invention, the filling material now has a filling material temperature during filling into the filling space that does not have a negative effect on the properties of the molding material before casting. In accordance with the invention, the filling material temperature, which the filling material has during filling into the filling space, is limited to less than 100° C. What is essential for the invention here is that no targeted heating of the filling material to a specific target temperature is carried out. Rather, the filling material is advantageously filled into the filling space at the temperature which it currently has, i.e. which it has adopted as a result, for example, of the ambient temperature at the location at which the filling material has been stored or of process heat which is generated, for example, in a recycling process or the like. Accordingly, the filling material temperature provided for in accordance with the invention is preferably at least equal to the room temperature, which prevails in the vicinity of the storage location of the filling material or of the respective casting device, or with which the filling material reaches the casting device into whose filling space it is filled without a targeted, active supply of heat. According to the invention, the filling material temperatures at which the filling material is filled into the filling space are typically in the range of 10° C. to 45° C., in particular 18-45° C., with typical room temperatures being in the range of 10-25° C., in particular 18-25° C., depending on the time of year.

Surprisingly, it turned out that, contrary to what was assumed in the prior art described at the beginning, it is not necessary to preheat the filling material. Rather, it has been shown that the gases, consisting of vaporizing binder components, that emerge from the casting mold after the melt has been poured out already begin to burn due to the heat introduced by the casting material. According to the knowledge gained from practical tests, this burning starts when there is sufficient gas flow through the filling material package filled into the filling space, without the need for additional heat input.

By using filling material according to the invention which is so cold that it does not negatively affect the properties of the molding material of the casting mold when it comes into contact with the casting mold and when it is filled into the filling space of the casting device used according to the invention, the method according to the invention can be implemented with considerably simplified plant technology compared to the prior art. In order to ensure that the filling material has a filling material temperature of less than 100° C., in particular at most 45° C., when it is filled into the filling space, the filling material can be actively or passively cooled if necessary.

The invention thus allows the process of filling the filling space with the filling material to be decoupled in terms of time from the filling of the casting mold with the respective metal melt. Since it is therefore no longer important for the filling material in the filling space to have a certain high temperature, such as, for example, at least 500° C., which is regarded as practical in the prior art, but a temperature at which there is no unfavorable influence on the molding material of the casting mold, the filling of the filling space can be carried out long before the metal melt is poured. The temporal decoupling of the filling process from the casting process, which is made possible in this way, makes process control significantly more robust and stable. The result is optimized operational reliability and at the same time simple practical implementation of the method.

The cooling of the casting in the method according to the invention is faster than in the prior art described at the beginning, since the cold, i.e. at a temperature of less than 100° C., in particular at most 45° C., preferably at room temperature, filled filling material acts as a heat sink, through which heat is removed from the casting mold until the temperature is equalized. The resulting faster solidification of the casting leads to increased dimensional stability of the workpiece. Since the energy input required in the prior art for heating the filling material is also avoided, the method according to the invention also proves to be more energy-efficient.

It has also been shown that with a suitably spatially extended design of the filling frame surrounding the filling space, the gases produced after the molten casting has been poured into the casting mold already emerge from the casting mold in a burning state and then continue to burn off. In this way, the parts and cores of the casting mold consisting of molding material disintegrate into fragments to such an extent that these fragments fall away from the casting and the casting is largely free of adhering mold parts or -cores, at least in the area of its outer surfaces, after the enclosure has been removed.

At this point, the cores have also disintegrated at least into coarse fragments that form channels or cavities inside the casting, so that the core sand and the mold material fragments of these cores either trickle out of the casting automatically in the enclosure or can be removed from the casting in a known manner, for example by mechanical methods such as vibration or by rinsing with a suitable fluid.

It has been shown here that the comminution systems available in the state of the art, in combination with the invention, enable economical processing of casting mold fragments.

The core sand fragments can be crushed in a conventional grinder, for example. The reclaimed sand obtained after processing can be mixed with new sand in a manner known per se.

In contrast to the prior art, the process according to the invention is therefore based on the idea of not only to stabilize the casting mold with the filling material, but also to accelerate the removal of heat in order to produce high-precision castings in a technologically and economically effective manner.

The filling material according to the invention filled into the filling space formed between the casting and the enclosure is free-flowing, so that it completely fills the filling space even if undercuts, cavities and the like are present in the area of the outer surfaces of the casting mold.

In the manner known from the prior art, the filling material used according to the invention has a bulk density which is so low that a gas flow can still flow through it even after the filling space has been filled and possibly compaction of the filling material filled into the filling space has been carried out. Thus, in contrast to the above-mentioned prior art, the invention expressly does not produce a highly compacted packing in the filling space, which ensures optimum support of the casting mold but is largely impermeable to gas. Rather, the filling material used according to the invention must be selected in such a way that it is permeable to a gas flow which occurs, for example, as a result of thermal convection. This occurs when the casting mold is heated by the metal melt poured into it and the vaporizing binder components of the molding material of the casting mold parts and -cores begin to vaporize and burn, releasing heat.

When talking about a vaporizing and burning binder here, it always referred to those binder components that become vaporous and combustible by heat input. This does not exclude the possibility that other binder components remain in the casting mold in solid or other form, for example as crack products, where they are ideally also decomposed by the heat input.

The ability of a gas flow to flow through the filling material filled into the filling space according to the invention and the large-volume design of the filling frame surrounding the filling space adapted to this not only create the possibility that the binder evaporating from the casting mold burns in the area of the filling material itself and thus heats up the filling material, but also allow the supply of oxygen, which supports the burning of the binder.

Casting molds whose mold parts and cores consist of molding material bound by an organic binder are particularly suitable for the method according to the invention. For example, commercially available solvent-based binders or binders whose effect is triggered by a chemical reaction are suitable for this purpose. Corresponding binder systems are used today in the so-called "cold box process".

The filling material temperature, which the filling material has when it is filled into the filling space, is, as mentioned, selected according to the invention in such a way that, even if the filling material is filled into the filling space before casting, there are no negative effects on the molding material and in particular on the binder, which holds together the grains of the molding material from which the parts and cores of the casting mold are formed.

From a cost point of view, it proves to be particularly advantageous that the effects achieved by the invention already occur when the filling material temperature is equal to the ambient temperature when the filling space is filled, i.e. is equal to the temperature prevailing at the place where the filling material is stored before it is filled into the filling space. In this variant of the invention, therefore, no temperature control of the filling material is carried out, so that, unlike in the prior art, no costs are incurred for temperature control and possibly necessary thermally insulated storage of the filling material.

As already mentioned, typical filling material temperatures according to the invention are in the range of up to 45° C.

As the binder escapes, burns and decomposes, the parts and cores of the casting mold formed from the molding material disintegrate into loose fragments, which can either be disposed of after the enclosure has been removed and sent for processing or, advantageously, can already be removed from the enclosure during the dwell time between the pouring of the metal melt and the removal of the enclosure. For this purpose, the casting mold can be placed on a sieve bottom and the fragments of the casting mold trickling through the sieve bottom can be collected. In practice, the openings of the sieve bottom are designed in such a way that the fragments of the casting mold and the filling material trickle through the sieve bottom together, are collected, processed and separated from each other after processing. This has the advantage that there is no loose filling material left in the enclosure when the enclosure is removed.

The enclosure of the casting mold can consist of a sufficiently rigid sheet material surrounding the casting mold with a sufficient distance for the formation of the filling space, wherein the thermal insulation of the sheet material is not subject to any special requirements. A perforated support plate acting as a sieve plate can be provided, on which the casting mold is placed. An exhaust gas opening can be provided to allow the exhaust gases that form in the filling space to be discharged in a controlled manner.

In the method according to the invention, the filling material filled into the filling space can also be compacted in a manner known per se in order to generate a prestress between the casting mold and the enclosure, which ensures that the casting mold is held together securely and precisely in position even if the casting mold is designed as a core package composed of a large number of mold parts and cores. As mentioned, however, the low bulk density ensures that a gas flow can flow through even with such a compacted filling material.

Channels specifically introduced into the casting mold can also be used to accelerate the cooling of certain zones on or in the casting or to avoid such accelerated cooling in order to achieve certain properties of the casting in the respective zone.

Granulates or other granular bulk material have proven to be suitable as filling material. Such bulk materials with bulk densities of max. 4 $kg/dm^3$, in particular less than 1 $kg/dm^3$ or even less than 0.5 $kg/dm^3$, are particularly suitable for the purposes according to the invention.

If a granular, pourable and free-flowing filling material is used, practical tests have shown it to be advantageous if the grains of the filling material are spherical. Preferably, the diameter of the spheres is in the range of 1.5-100 mm, in particular 1.5-40 mm.

In principle, all thermally resilient bulk materials that meet the above conditions and are sufficiently temperature-resistant are suitable as filling material. Non-metallic bulk materials, such as granulates made of ceramic materials, are particularly suitable for this purpose. These can be irregularly shaped, spherical or provided with cavities in order to achieve good gas permeability of the filling material filled into the filling space with low heat storage properties at the same time. The filling material can also consist of ring-shaped or polygonal elements which, when in contact with each other, only touch at points so that there is sufficient space between them to ensure a good flow.

For example, the filling material can consist of ceramic or fireproof materials.

The casting exposed after demolding in accordance with the invention can undergo a heat treatment in a manner known per se after the casting mold has disintegrated, in which it is cooled in a controlled manner in a manner known per se in accordance with a specific cooling curve in order to produce a specific state of the casting.

Of course, with the method according to the invention, several casting molds can be accommodated together in one enclosure at the same time and these casting molds can be filled with metal melt in parallel or in close succession.

In principle, the method according to the invention is suitable for any type of metallic cast material whose processing generates a sufficiently high process heat. The method according to the invention is particularly suitable for producing castings from cast iron, since the temperatures according to the invention required for burning the binder are achieved particularly reliably due to the high temperature of the cast iron melt. In particular, GJL, GJS and GJV cast iron materials and cast steel can be processed in accordance with the invention.

The method according to the invention is particularly suitable for the casting production of cylinder crankcases and cylinder heads for internal combustion engines. In particular, if the components in question are intended for commercial vehicles, they and the casting mold required for their manufacture have a comparably large volume, in which the advantages of the method according to the invention are particularly evident.

BRIEF DESCRIPTION OF THE DRAWINGS

The invention is explained in more detail below with reference to a drawing showing an embodiment. The figures show schematically in each case.

DESCRIPTION OF THE INVENTION

Figure 1:
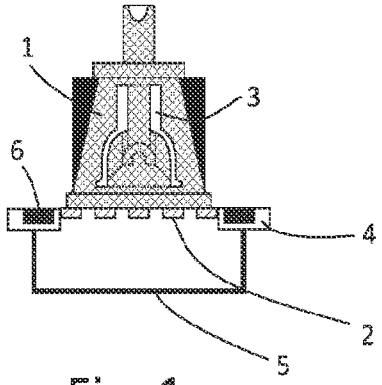
FIGS. 1-10 different phases of the implementation of the method according to the invention, each with components shown in a section along their longitudinal axis.

As in the prior art known from WO 2016/016035 A1, casting mold parts and cores are provided in the method according to the invention.

The casting cores and -mold parts are conventionally produced in a cold-box process from a conventional molding material, which may be a mixture of a commercially available core sand, an equally commercially available organic binder and optionally added additives, which serve, for example, to improve the wetting of the grains of the core sand by the binder. After molding, the resulting casting cores and -mold parts are gassed with a reaction gas in order to harden the organic binder through a chemical reaction and thereby give the casting cores and -mold parts the necessary dimensional stability.

A casting mold 1 is assembled from the casting mold parts and -cores provided in this conventional manner in an equally known manner to form a casting mold 1 designed as a so-called "core package". In addition, the casting mold 1 can comprise components made of steel or other indestructible materials. These include, for example, cooling molds and the like, which are arranged in the casting mold 1 in order to achieve directional solidification of the casting G by accelerated solidification of the melt coming into contact with the cooling mold.

The casting mold 1 is intended for the casting production of a casting G, which in this example is a cylinder crankcase for a commercial vehicle combustion engine.

New filling material, for example granular, in particular spherical, ceramic granulate with a grain size of 1.5-25 mm determined in a conventional manner by sieving, is also provided, which is at room temperature (typically 18-25° C.), wherein filling material temperatures of up to 45° C. are practical here.

Furthermore, these raw materials can be reused in a cycle, as explained below.

The device T shown in FIGS. 1-8 in various phases of the method according to the invention has a sieve plate 2 on which the casting mold 1 prepared for pouring a cast iron melt is placed.

The casting mold 1 delimits a mold cavity 3 from the surroundings U, into which the cast iron melt is poured to form the casting G. The iron melt flows into the mold cavity 3 via an ingate system, which is not shown here for the sake of clarity.

The edge of the sieve plate 2 is supported on a circumferential edge shoulder 4 of a collection container 5. A sealing element 6 is incorporated into the circumferential contact surface of the edge shoulder 4.

After the casting mold 1 is positioned on the sieve plate 2, an enclosure 7, which is also part of the device T, is placed on the circumferential edge shoulder 4 of the collection container 5. The enclosure 7 is designed like a hood and encases the casting mold 1 on its outer circumferential surfaces 8. The circumference of the space enclosed by the enclosure 7 is oversized compared to the circumference of the casting mold 1, so that a filling space 10 is formed between the outer circumferential surface of the casting mold 1 and the inner surface 9 of the enclosure 7 after the enclosure 7 has been placed on the sieve plate 2. With its edge associated with the collection container 5, the enclosure 7 sits on the sealing element 6, so that a tight seal of the filling space 10 with respect to the surroundings U is ensured.

Figure 2:
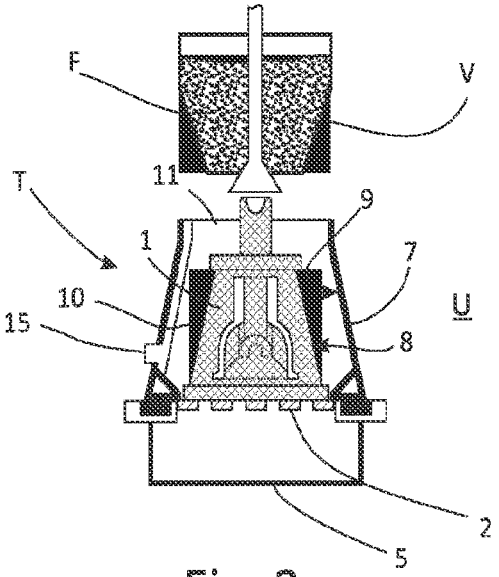

The enclosure consists of a sheet metal material whose thermal insulating properties are not subject to any special requirements. The sheet metal material is designed in a known manner to ensure the necessary dimensional stability of the enclosure 7. On its upper side, the enclosure 7 has a large opening 11 through which the casting mold 1 can be filled with cast iron melt and the filling space 10 with filling material F (FIG. 2).

Figure 3:
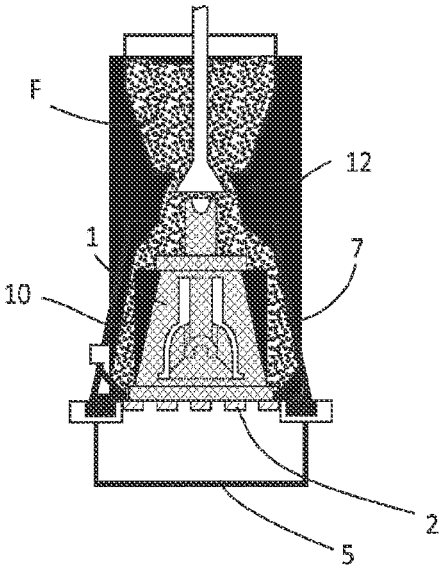

To fill the filling space 10 with the unheated and provided filling material F, i.e. at a filling material temperature that is at least equal to room temperature and at most 45° C., a storage container V is positioned above the opening 11, from which the untampered filling material F is then allowed to trickle into the filling space 10 via a distribution system 12 (FIG. 3).

Figure 4:
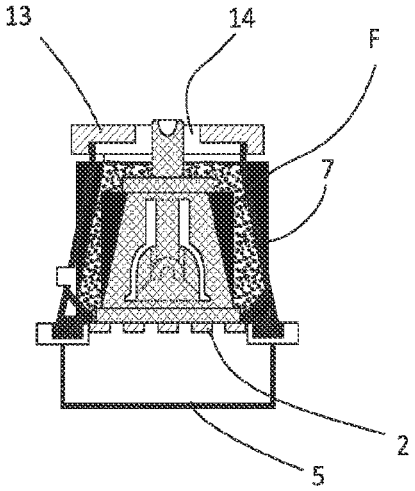

When the filling process is complete, the filling material package filled into the filling space 10 can be compacted if necessary. A lid 13 is then placed on the opening 11, which also has an opening 14 through which the cast iron melt can be poured into the casting mold 1 (FIG. 4).

Figure 5:
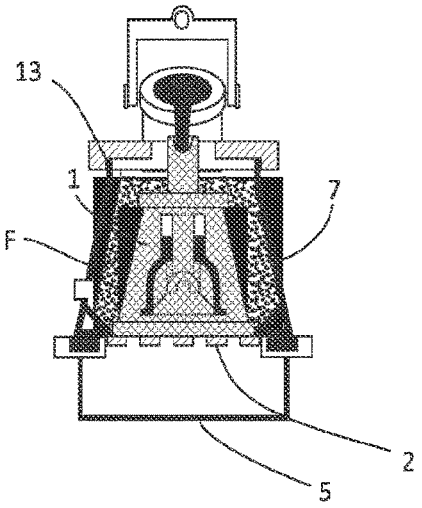

The cast iron melt is then poured into the casting mold 1 (FIG. 5).

Figure 6:
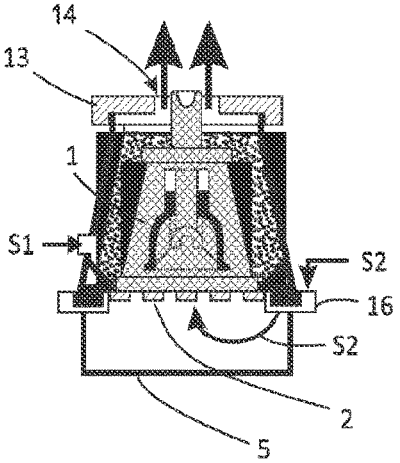

Meanwhile, oxygen-containing ambient air can enter the filling space 10 via a gas inlet 15 formed in the lower edge area of the enclosure 7. Similarly, ambient air that enters the collection container 5 via an inlet 16 is drawn into the filling space 10 through the sieve bottom 2 (FIG. 6).

The intentional destruction of the casting mold 1 that begins with the pouring of the cast iron melt and the associated demolding of the casting G takes place in two phases.

In the first phase, the solvent contained in the binder evaporates. The vaporous solvent escaping from the casting mold 1 burns due to the heat radiated by the casting G as it exits the casting mold 1. The burning of the binder components and other potential pollutants escaping from the casting mold 1 continues without further energy input until no more binder evaporates from the casting mold 1. The vaporous substances that may still be escaping from the casting mold 1 are oxidized or otherwise rendered harmless by the high temperature prevailing in the filling space 10.

The oxygen-containing gas flows S1, S2 formed from ambient air, which enter the filling space 10 of the enclosure 7 via the gas inlet 15 and the sieve bottom 2, also contribute to the complete burning of the gases emerging from the casting mold 1.

As the bulk density of the filling material F is so low that even after compaction, good gas permeability of the filling material package present in the filling space 10 is ensured, good mixing of the gases emerging from the casting mold 1 with the gas flows S1, S2 providing oxygen for its burning is guaranteed. At the same time, the filling material package in the filling space 10 supports the casting mold 1 at its circumferential surfaces 8 and thus prevents the cast iron melt from breaking through from the casting mold 1.

Figure 7:
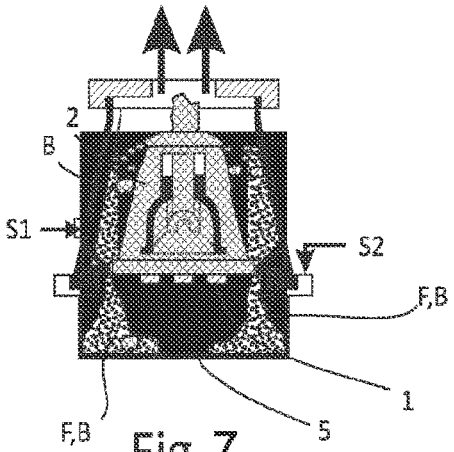

The mold parts and cores of the casting mold 1 disintegrate into fragments B or individual grains of sand, which fall through the sieve bottom 2 into the collection container 5 and are collected there. Depending on the progress of the destruction of the casting mold 1, the sieve bottom 2 can be opened so that filling material F also reaches the collection container 5 (FIG. 7).

The progress of the destruction of the casting mold 1 and the solidification process of the cast iron melt poured into the casting mold 1 are adapted to each other in such a way that the casting G is sufficiently solidified when the disintegration of the casting mold 1 begins. The low temperature of the filling material F helps to ensure that the casting mold 1 and the casting G cool down quickly. In this way, a particularly good dimensional accuracy of the casting G is achieved.

Figure 8:
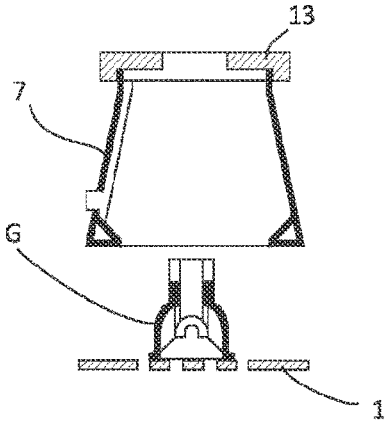
Figure 9:
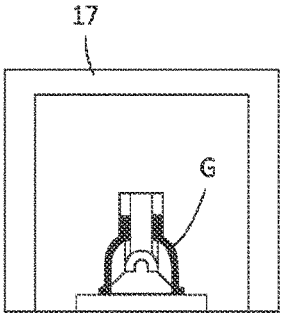
Figure 10:
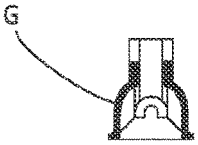

After the casting mold 1 has essentially completely disintegrated, the collection container 5 with the mixture of molding material and filling material it contains is separated from the sieve bottom 2 and the enclosure 7 is also removed from the sieve bottom 2 (FIG. 8). The largely desanded casting G is now freely accessible and can be cooled in a controlled manner in a tunnel-like space 17 provided for this purpose (FIG. 9).

Due to the process, the casting G has a high temperature during removal, at which the austenite transformation is not yet complete and rapid cooling would lead to residual stresses and therefore cracks. For this reason, the casting G is cooled slowly in a cooling tunnel 17 in accordance with the annealing curves during stress relief annealing. The cooling air supplied is dimensioned so that the cooling profile is achieved for the specific product.

The still hot mixture of filling material F, core sand and fragments B collected in the collection container 5 is processed in the manner described in WO 2016/016035 A1.

The core sand obtained from the processing is made available for the production of new casting mold parts and -cores.

The filling material F obtained from the processing is cooled to room temperature in the air without additional energy input and stored in the storage container V for a refilling the filling space 10.

The invention thus provides a method for casting castings (G), in which a metal melt is poured into a casting mold 1, the casting mold 1, formed as a lost mold, consists of one or more casting mold parts or -cores which are formed from a molding material consisting of a core sand, a binder and optionally one or more additives for adjusting certain properties of the molding material. In the course of the method according to the invention the respective mold 1 is provided, the casting mold 1 is enclosed in a housing 7, forming a filling space 10 between at least one inner surface section 9 of the housing 7 and an associated outer surface section 8 of the casting mold 1, the filling space 10 is filled with a free-flowing filling material F which has such a low bulk density that a gas flow S1, S2 can flow through the filling material package formed there from the filling material F after the filling of the filling space, and the metal melt is poured into the casting mold 1, wherein the casting mold 1 begins to radiate heat as the metal melt is poured in, as a result of the heat input caused by the hot metal melt, and wherein as a result of the heat input caused by the metal melt, the binder of the molding material begins to evaporate and burn, so that it loses its effect and the casting mold 1 disintegrates into fragments B.

By the filling material F having according to the invention a filling material temperature of less than 100° C. when the filling material is filled into the filling space 10, the rapid and energy-efficient decomposition of the casting mold 1 can be achieved with reduced effort.

REFERENCE SIGNS

1 Casting mold
2 Sieve plate
3 Mold cavity
4 Circumferential edge shoulder
5 Collection container
6 Sealing element
7 Enclosure (housing)
8 Circumferential surfaces of the casting mold 1
9 Inner surface of the enclosure 7
10 Filling space
11 Opening of the enclosure
12 Distribution system
13 Lid
14 Opening of the lid 13
15 Gas inlet
16 Inlet
17 Cooling tunnel
B Fragments
F Filling material
G Casting
S1,S2 Oxygen-containing gas flows
T Device
U Surrounding
V Storage container

The invention claimed is:

1. A method for casting castings, in which a metal melt is poured into a casting mold which surrounds a cavity forming a casting to be produced, wherein the casting mold, formed as a lost mold, comprises one or more casting mold parts or cores which are formed from a molding material consisting of a core sand, a binder, and optionally one or more additives for adjusting certain properties of the molding material, the method comprising the following working steps:

providing the casting mold;

enclosing the casting mold in a housing, forming a filling space between at least one inner surface section of the housing and an associated outer surface section of the casting mold;

filling the filling space with a free-flowing filling material, wherein the filling material filled into the filling space has a bulk density that allows gas to flow through the filling material after the filling of the filling space; and pouring the metal melt into the casting mold, wherein the casting mold begins to radiate heat as the metal melt is poured in, as a result of heat input from the metal melt, and wherein as a result of the heat input caused by the metal melt, the binder of the molding material begins to evaporate and burn, no longer binding the molding material, and the casting mold disintegrates into fragments, and wherein the filling material has a filling material temperature of less than 100° C. when it is filled into the filling space.

2. The method according to claim 1, wherein the filling material temperature is at most 45° C. when the filling material is filled into the filling space.

3. The method according to claim 1, wherein the filling material temperature is at least equal to room temperature.

* * * * *